US009381616B2

(12) United States Patent
Yamamoto et al.

(10) Patent No.: US 9,381,616 B2
(45) Date of Patent: Jul. 5, 2016

(54) SHOT PROCESSING MACHINE

(71) Applicant: SINTOKOGIO, LTD., Nagoya-shi, Aichi (JP)

(72) Inventors: Shoichi Yamamoto, Toyokawa (JP); Ryo Tatematsu, Toyokawa (JP); Takeshi Sugiura, Toyokawa (JP); Kyouji Yamashita, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 0 days.

(21) Appl. No.: 14/404,319

(22) PCT Filed: Jun. 19, 2013

(86) PCT No.: PCT/JP2013/066830
§ 371 (c)(1),
(2) Date: Nov. 26, 2014

(87) PCT Pub. No.: WO2014/024572
PCT Pub. Date: Feb. 13, 2014

(65) Prior Publication Data

US 2015/0151407 A1 Jun. 4, 2015

(30) Foreign Application Priority Data

Aug. 6, 2012 (JP) ..... 2012-173714

(51) Int. Cl.
*B24C 9/00* (2006.01)

(52) U.S. Cl.
CPC ..... *B24C 9/00* (2013.01)

(58) Field of Classification Search
CPC ..... B24C 9/00; B24C 1/003; B24C 3/06; B24C 1/04; B24C 3/04
USPC ..... 451/38–40, 75–102
See application file for complete search history.

(56) References Cited

U.S. PATENT DOCUMENTS 2,429,742 A * 10/1947 Barnes ..... B24C 3/04 451/40
4,598,501 A * 7/1986 Vasek ..... B24C 3/263 451/86

(Continued)

FOREIGN PATENT DOCUMENTS

CN 1758853 A 4/2006
JP 60-34272 A 2/1985

(Continued)

OTHER PUBLICATIONS

Office Action and Search Report, and partial English language translation thereof, in corresponding Chinese Application No. 201380002999.7, dated Aug. 18, 2015, 8 pages.

*Primary Examiner* — George Nguyen
(74) *Attorney, Agent, or Firm* — Brinks Gilson & Lione

(57) ABSTRACT

The present invention has the object of providing a shot processing machine capable of constraining the spilling over and dropping of projection material to outside the projection chamber. The shot processing machine of the invention is a shot processing machine for performing surface treatment by projecting projection material onto a workpiece inside a projection chamber, comprising: a cabinet inside of which a projection chamber is formed, an opening disposed on the cabinet for loading and discharging workpieces; and a door movably attached to the cabinet, for opening and closing the opening, whereby a projection material adhesion prevention mechanism for preventing the adhesion of projection material is provided on the inside of the door.

16 Claims, 15 Drawing Sheets

(56) References Cited

U.S. PATENT DOCUMENTS

| | | | | | |
|---|---|---|---|---|---|
| 5,049,260 | A * | 9/1991 | Spears | B03B 5/62 | 209/157 |
| 5,397,421 | A | 3/1995 | Fujutani | | |
| 5,676,588 | A * | 10/1997 | Frederick | B24C 1/003 | 451/75 |
| 5,846,338 | A * | 12/1998 | Bonora | B08B 9/093 | 134/11 |
| 5,906,536 | A * | 5/1999 | Imazato | B24C 3/322 | 451/75 |
| 5,944,509 | A * | 8/1999 | Masters | B05B 15/045 | 156/153 |
| 6,283,839 | B1 * | 9/2001 | Frederick | B24C 3/263 | 451/86 |
| 6,364,748 | B1 * | 4/2002 | Zwicker | B24C 9/00 | 451/38 |
| 2002/0168924 | A1 * | 11/2002 | Visaisouk | B24C 1/003 | 451/39 |
| 2006/0135048 | A1 * | 6/2006 | Sommacal | B24C 1/003 | 451/89 |
| 2006/0281823 | A1 | 12/2006 | Uchikoshi et al. | | |
| 2009/0047878 | A1 | 2/2009 | Umemura et al. | | |
| 2009/0156102 | A1 * | 6/2009 | Rivir | B24C 1/003 | 451/60 |
| 2010/0178854 | A1 | 7/2010 | Nakayama | | |
| 2012/0252327 | A1 | 10/2012 | Kobayashi et al. | | |

FOREIGN PATENT DOCUMENTS

| | | | |
|---|---|---|---|
| JP | 6-126636 | A | 5/1994 |
| JP | 6-80549 | U | 11/1994 |
| JP | 7-276240 | A | 10/1995 |
| JP | 10-151566 | A | 6/1998 |
| JP | 2000-6028 | A | 1/2000 |
| JP | 2004-90185 | A | 3/2004 |
| JP | 2011-79120 | A | 4/2011 |
| WO | WO 2004/077955 | A1 | 9/2004 |
| WO | WO 2006/109674 | A1 | 10/2006 |
| WO | WO 2007/072553 | A1 | 6/2007 |
| WO | WO 2011/064983 | A1 | 6/2011 |
| WO | WO 2012/086234 | A1 | 6/2012 |

* cited by examiner

UP
FR
RH 10
12
14
16
18
20
26
46
52
54
60
66

UP
FR
100
32
36
42
44
30
40
26
12
52
54

SHOT PROCESSING MACHINE

This application is a 371 application of PCT/JP2013/066830 having an international filing date of Jun. 19, 2013, which claims priority to JP 2012-173714 filed Aug. 6, 2012, the entire contents of which are incorporated herein by reference.

TECHNICAL FIELD

The present invention relates to a shot processing machine, and more particularly to a shot processing machine wherein projection material is projected onto a workpiece inside a projection chamber.

BACKGROUND ART

It is known a shot processing machine in which projection material is projected onto workpieces to perform a surface treatment as multiple workpieces are stirred within a projection chamber (blast cleaning chamber) provided within a cabinet. (see Patent Document 1)

An opening for loading and discharging workpieces is formed in the projection chamber, and a door for closing off the opening attached to the opening.

PRIOR ART REFERENCES

Patent Document

Patent Document 1: Japanese Patent Unexamined Publication Application 2011-79120

SUMMARY OF THE INVENTION

Problem the Invention Seeks to Resolve

In a shot blasting machine thus constructed, when surface treatment of a workpiece inside the projection chamber is completed, the door provided on the projection chamber is opened and the processed workpiece is removed from an opening for loading/discharging the workpiece. However, the problem has occurred that when the door is opened, projection material adhering to or deposited on the inside of the door spills over and drops outside the cleaning chamber.

With this problem in mind, the present invention has the object of providing a shot processing machine capable of constraining the spilling over and dropping of projection material to outside the projection chamber.

Means for Resolving the Problems

The invention is a shot processing machine for performing surface treatment by projecting projection material onto a workpiece inside a projection chamber, comprising:

a cabinet within which the projection chamber is formed;

an opening disposed on the cabinet, for loading and discharging workpieces;

and a door movably attached to the cabinet for opening and closing the opening;

wherein a projection material adhesion prevention mechanism for preventing the adhesion of projection material is provided on the inside of the door.

In the invention thus constituted, a projection chamber is provided inside a cabinet, and the projection chamber is opened through the opening. There is a door attached to the cabinet, and the door is capable of moving between a closed position and an open position. Thus, by placing the door in a closed position, the opening is blocked by the door, and by moving the door to the open position, the opening is opened.

Here a projection material adhesion prevention mechanism is provided on the inside of the door, and projection material, which has scattered toward the door during shot processing inside the projection chamber, is prevented from adhering to the inside of the door.

Thus, by providing a projection material adhesion prevention mechanism on a projecting part of the inside surface of the door (the projection chamber side), for example, accumulation of projection material on this projecting part is constrained.

Therefore spilling over and dropping of projection material to outside the projection chamber when the door opens can be constrained.

In another preferred embodiment of the invention, an inside liner and a fixing member for fixing said inside liner to the door are provided on the inside surface of the door;

and the projection material adhesion prevention mechanism is constituted by an angled surface formed on the top end surface of the fixing member.

According to this constitution, an inside liner is provided on the inside surface of the door, and this inside liner is fixed to the door by a fixing member. Because the angled surface forming the projection material adhesion prevention mechanism is formed on the top end surface of a fixing member, accumulation of projection material on the top end surface of the fixing member for fixing the inside liner to the door can be constrained.

In another preferred embodiment of the invention, the fixing member is an elongated plate-shaped member disposed on the inside surface of the door so as to extend in the vertical direction;

and the angled surface is oriented so that the edge on one side thereof in the width direction of the fixing member is low.

According to this constitution, the fixing member is an elongated plate-shaped member, disposed to extend vertically. Since the inside liner is fixed to the door by such a fixing member, curling up of the inside liner is constrained. Therefore curling up of the inside liner is constrained, and accumulation of projection material on the top end surface of the fixing member is also constrained.

In another preferred embodiment of the invention, the angled surface is oriented so that the center side in the width direction of the door is low.

According to this constitution, the angled surface is oriented so that the center side in the width direction of the door is low, therefore projection material reaching the inside surface of the door can be collected by the angled surface at the center in the width direction of the projection chamber.

Another preferred embodiment of the invention further comprises:

an agitating mechanism, disposed at the bottom portion of the projection chamber, for agitating workpieces housed in the projection chamber by disposing them on an agitating belt to move them back and forth, wherein the agitating belt is oriented to move along an L-shaped path, and the tip of the horizontal portion of said L-shaped path is disposed adjacent to the inside surface of the door;

whereby a return portion is provided on the inside surface of the door to constrain collisions with the door side by workpieces disposed on the agitating belt caused by the forward and backward movement of said agitating belt;

and a gap is formed between said return portion and the agitating belt.

According to this constitution, the agitating mechanism having an agitating belt on which workpieces are disposed is provided inside the projection chamber. Clockwise rotation of this agitating belt agitates the workpieces, and in this state the workpieces are surface treated by the projection of projection material toward the workpieces. In addition, when the agitating belt is rotated counterclockwise after completion of surface treatment, workpieces are moved to the opening side, and are taken out from the opening.

According to this constitution, collisions with the door by workpieces being agitated by the agitating belt are constrained by the return portion provided on the inside surface of the door.

Moreover, a gap is formed between the return portion and the agitating belt, so that accumulation of projection material between the return portion and the agitating belt is constrained, and spilling over and dropping of projection material from the projection chamber is further constrained.

Namely, when the return portion is contacting the agitating belt, it becomes easier for projection material to accumulate at this contacting part, and when the door is moved from the closed position to the open position, projection material accumulated at this contacting part spills over and drops, directed toward the projection chamber by the return portion. However, if a gap is formed between the return portion and the agitating belt in the constitution above, accumulation of projection material between the return portion and the agitating belt is constrained, and spilling over and dropping of projection material from the projection chamber is further constrained.

In another preferred embodiment of the invention:

the agitating belt is an endless belt;

and the track thereof is an endless track.

In another preferred embodiment of the invention:

the return portion is attached to the door with a gap formed between the door and the return portion.

According to this constitution, accumulation of projection material between the return portion and the door is constrained due to the formation of a gap between the return portion and the door. Spilling over and dropping of projection material from the projection chamber is thus further constrained.

In another preferred embodiment of the invention:

a first seal member for contacting the inside liner when the door closes off the opening is provided around the perimeter of the opening in the cabinet;

and a second seal member for sealing between the cabinet and the door when the door is closing off the opening is provided on the outer side of the first seal member.

According to this constitution, the space between the cabinet and the door is sealed by the first seal member when the door closes the opening.

When projecting projection material onto a workpiece, projection material which is projected inside the projection chamber hits the first seal member and inside liner, therefore the first seal member and inside liner should be comprised of a relatively high hardness material. Hence there is a possibility that sealing characteristics between the cabinet and door will degrade.

However, in the constitution above a second seal member is provided on the outer side of the first seal member in order to seal between the cabinet and the door when the door is closing off the opening. Thus even when projection material jumps out from between the first seal member and the inside liner, leakage to the outside of projection material is restrained by the second seal member.

Another preferred embodiment of the invention comprises:

a control section for controlling the opening and closing of the door;

whereby when the door is being moved from a closed position in which the opening is closed to an open position in which the opening is opened, the control section implements a control so that the door is moved from the closed position toward the open position, then is temporarily stopped, then moved to the open position.

According to this constitution, projection material adhered to or piled up on the back surface of the door falls inside the projection chamber when the door is temporarily stopped.

In another preferred embodiment of the invention, the control section controls the rotation of the agitating belt;

and when the door is moved from the opening to the closed position, the control section implements a control so that the agitating belt is turned in the clockwise direction, then the door is moved from the closed position toward the open position, following which the door is temporarily stopped, then again moved to the closed position, after which the door is moved to the open position.

According to this constitution, the door can be moved to the open position after projection material has been thoroughly removed from the workpiece.

By returning the door temporarily to the closed position, projection material adhering to or otherwise on the door can be made to drop into the projection chamber.

Another preferred embodiment of the invention comprises:

a receiving plate which forms the bottom portion of the opening and projects from the cabinet at a position below the door;

whereby the door and the receiving plate overlap in the up-down direction at the position where the door is temporarily stopped when moving from the closed position.

According to this constitution, a receiving plate is disposed directly underneath the door at the position at which the door is temporarily stopped. Therefore projection material adhering to or otherwise on the door can be caused to drop into the projection chamber, mediated by the receiving plate, at the position at which the door is temporarily stopped. Thus projection material adhering to or otherwise on the door can be effectively prevented from spilling over and dropping from the projection chamber when the door opens.

Another preferred embodiment of the invention comprises:

a projection material guide mechanism held between the door and the opening, for guiding projection material dropping when the door is opened, toward the bottom of the projection chamber.

In such a constitution, projection material dropping when the door is open adheres to workpieces inside the projection chamber, is prevented from being carried away from the shot processing machine.

In another preferred embodiment of the invention, the projection material guide mechanism comprises a flow straightening plate provided on the return portion, and a receiving plate provided at the bottom end of the opening.

Effect of the Invention

The invention thus constituted provides a shot processing machine capable of constraining the dropping of projection material to outside the projection chamber.

DETAILED DESCRIPTION OF THE PREFERRED EMBODIMENTS

Figure 1:
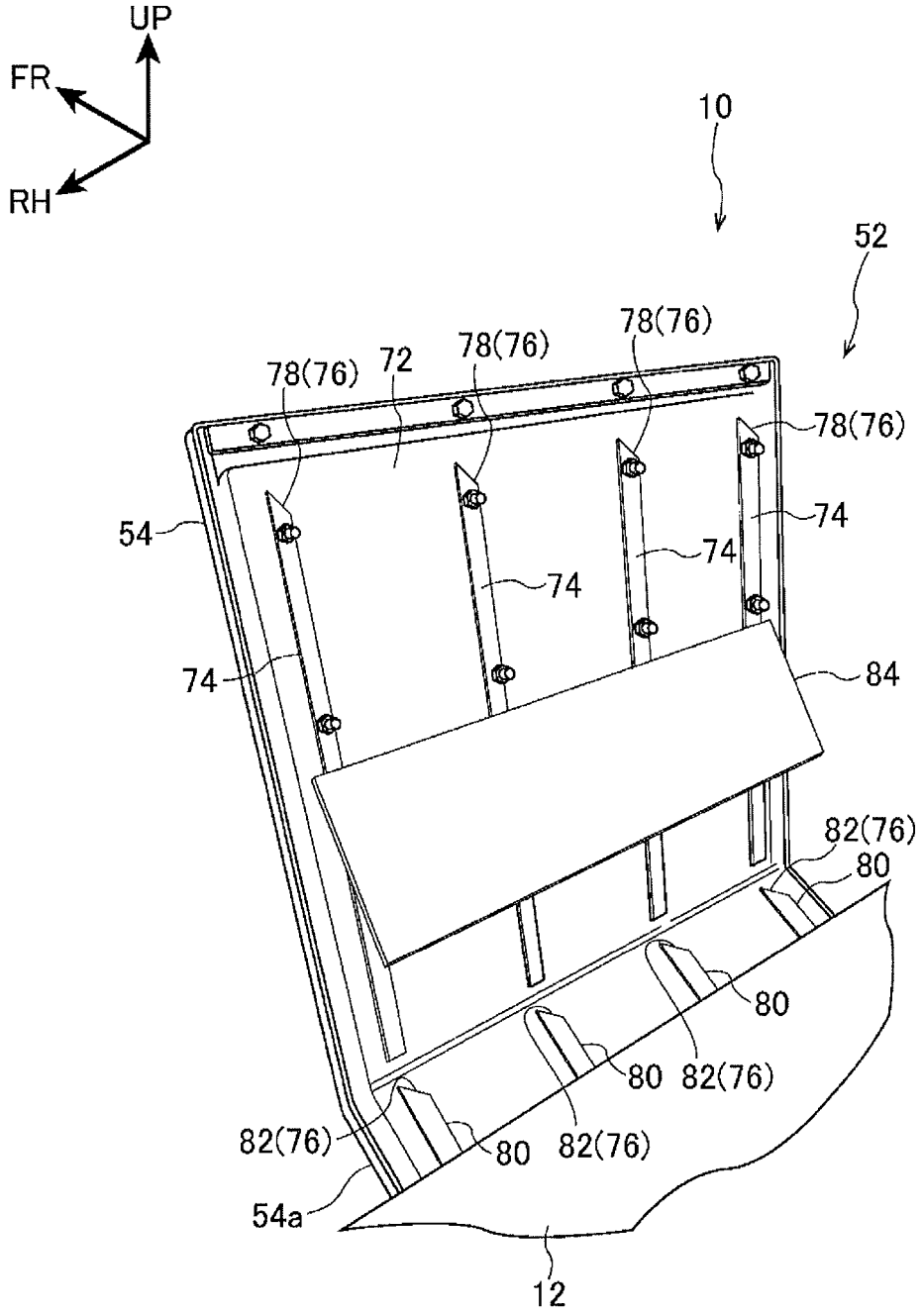
FIG. 1 is a perspective view showing the state in which a door used in a shot blasting machine of the first embodiment of the present invention, is disposed in the open position.

Next, referring to drawings, a shot processing machine according to a preferred embodiment of the invention will be explained. First a shot blasting machine 10, which is the first embodied shot processing machine of the invention, will be explained. Note that in the diagram the arrow FR indicates the front of the shot blasting machine 10; the arrow RH indicates the right of the shot blasting machine 10; and arrow UP indicates the top of the shot blasting machine 10.

As shown in FIGS. 2 through 5, the shot blasting machine 10 comprises a cabinet 12, a projection unit 46, and a control section 86.

The cabinet 12 is disposed at approximately the center portion in the front to rear direction of the shot blasting machine 10. This cabinet is approximately box-shaped, and the top portion of a front wall 14 of the cabinet 12 is disposed to incline so that the bottom side thereof is positioned at the front.

Figures 12A, 12B, 12C, 12D, 12E:
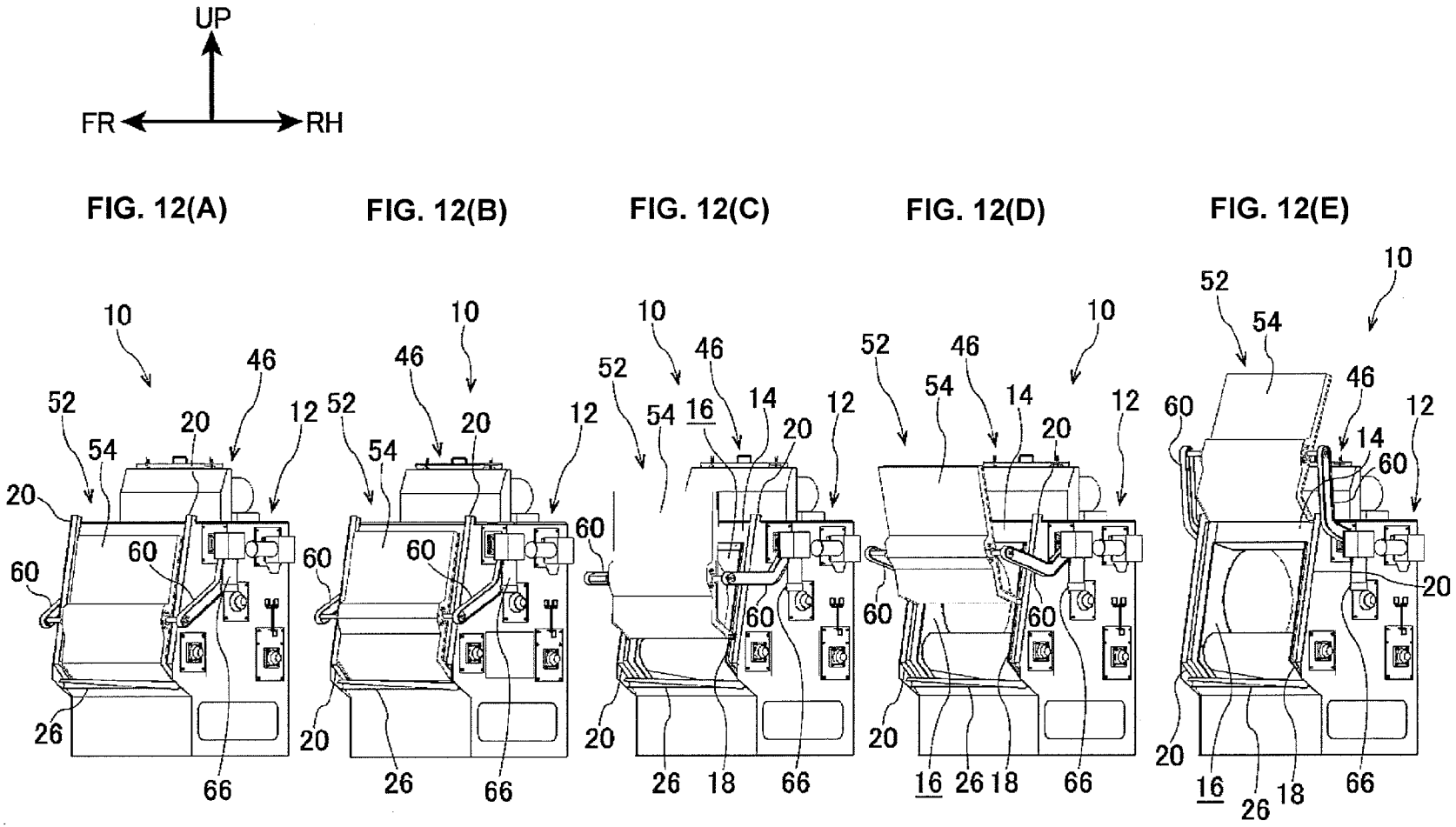
FIG. 12(A) is a perspective view showing the state in which a door in the FIG. 2 shot blasting machine is disposed in the closed position.
FIG. 12(B) is a perspective view showing the state in which the door shown in FIG. 12(A) is moved to a half-open position.
FIG. 12(C) is a perspective view showing the midway state when the door is moved from the FIG. 12(B) state to the open position.
FIG. 12(D) is perspective view showing the midway state when the door is moved from the FIG. 12(C) state to the open position.
FIG. 12(E) is a perspective view showing the state in which the door is disposed at the open position.

As shown in FIGS. 12(C) through (E), a projection chamber 16 is formed inside the cabinet 12. The projection chamber 16 is able to communicate with the outside through an opening 18 formed in the front wall 14 of the cabinet 12. A door unit 52 is provided on the front wall 14, and a door 54 is provided on the door unit 52 so as to be movable, is closed so as to be able to open and close the opening 18.

Figure 7:
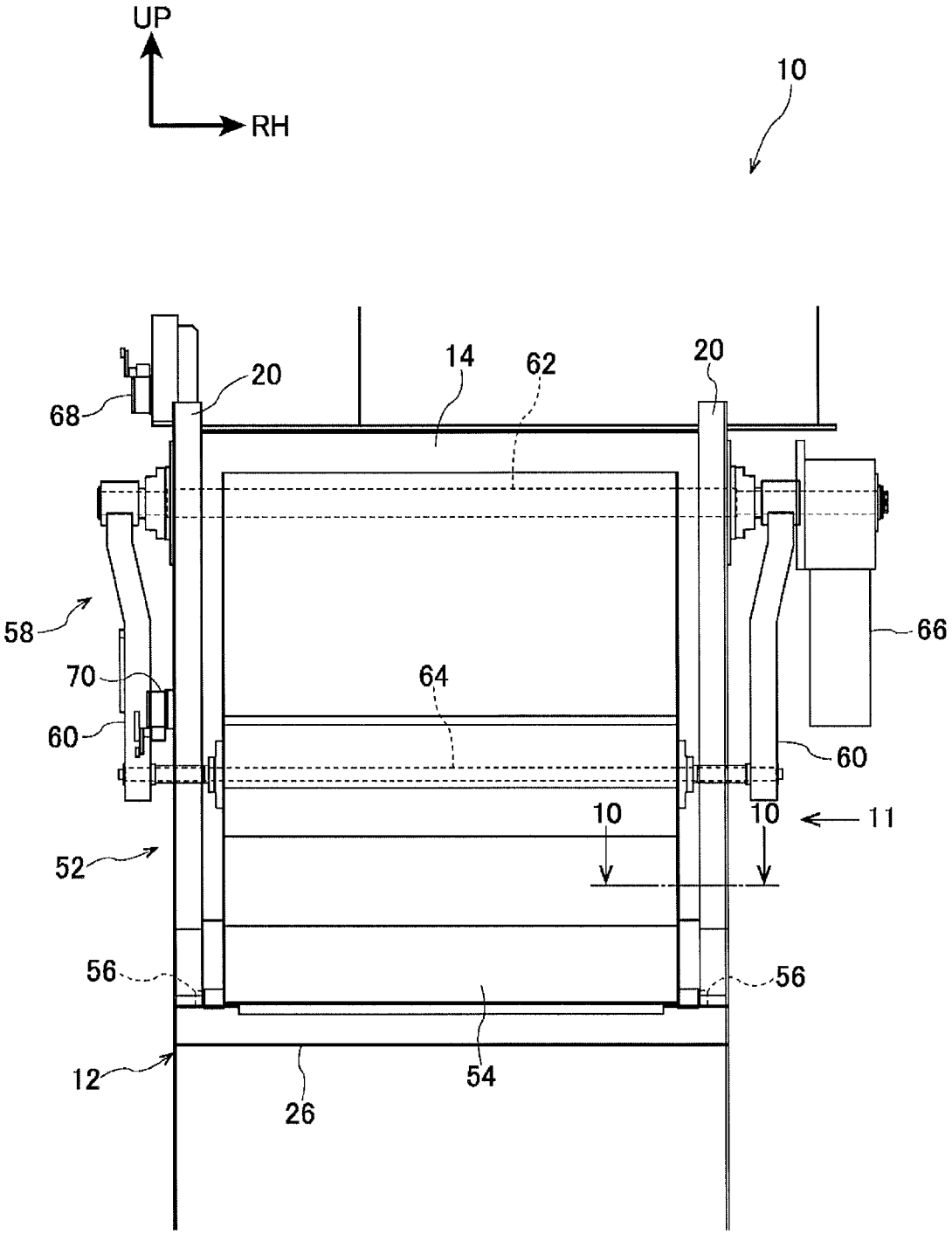
FIG. 7 is a front elevation view of a door unit used on the FIG. 2 shot blasting machine.

Also, as shown in FIG. 7, a pair of guide rails 20 for guiding the opening and closing motion of the door 54 is provided on the front wall 14 of the cabinet 12. The guide rails 20 are disposed to extend in the vertical direction along the front wall 14 of the cabinet 12 at both side portions in the width direction of the front wall 14. Each of the guide rails 20 has a U-shaped cross section, and the opening edge of the U-shape is oriented to face toward the inside of the front wall 14 in the width direction.

Figure 10:
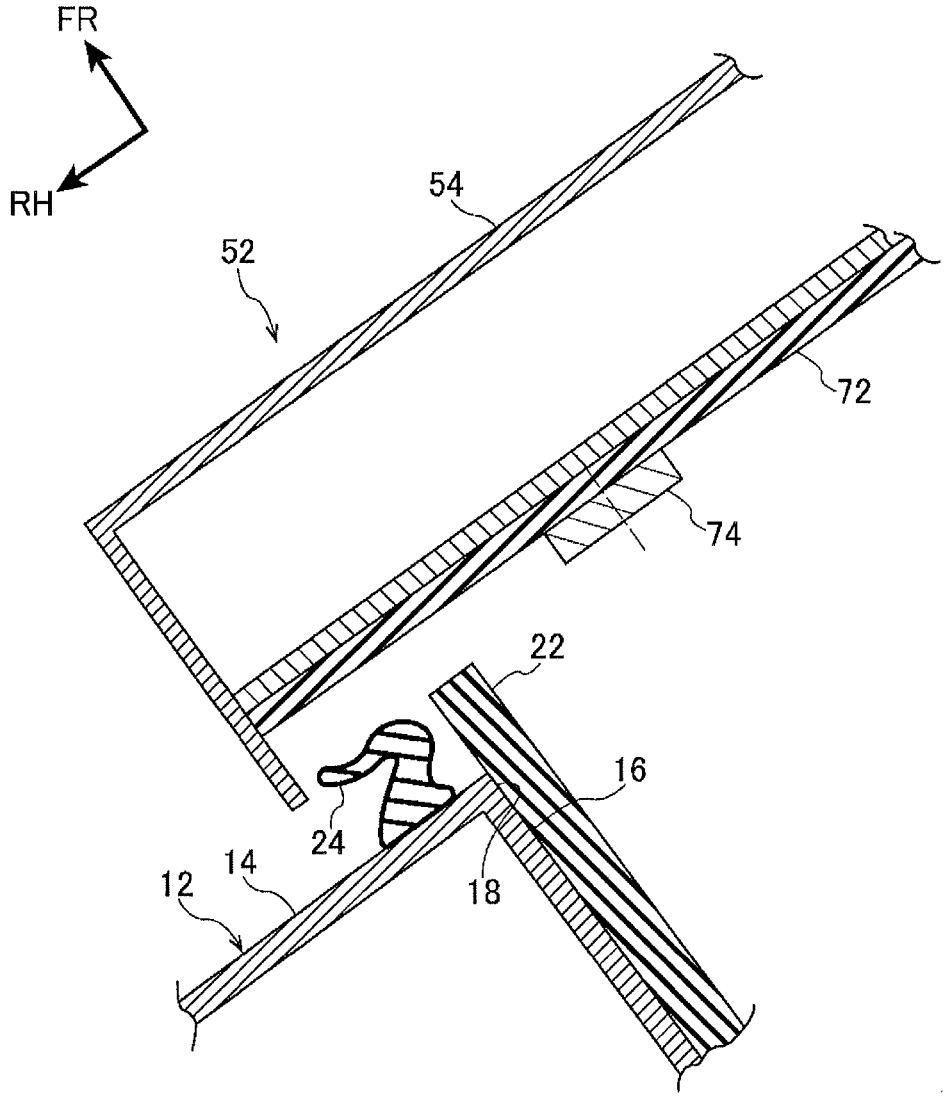
FIG. 10 is a cross section view taken along a line 10-10 in FIG. 7.

In addition, as shown in FIG. 10, a seal liner 22 (first seal member) formed of steel plate is disposed on the inner circumference of the opening 18 in the cabinet 12. The seal liner 22 is disposed to protrude forward from the cabinet 12 on the inside of each side of the opening 18 except for the bottom side.

A packing 24 (second seal member), formed of an elastic material such as sponge, is disposed at a position outside to the seal liner 22. This packing 24 is approximately Z shaped in cross section, and is adhered to the front wall 14 of the cabinet 12 at a position outside seal liner 22.

Figure 8:
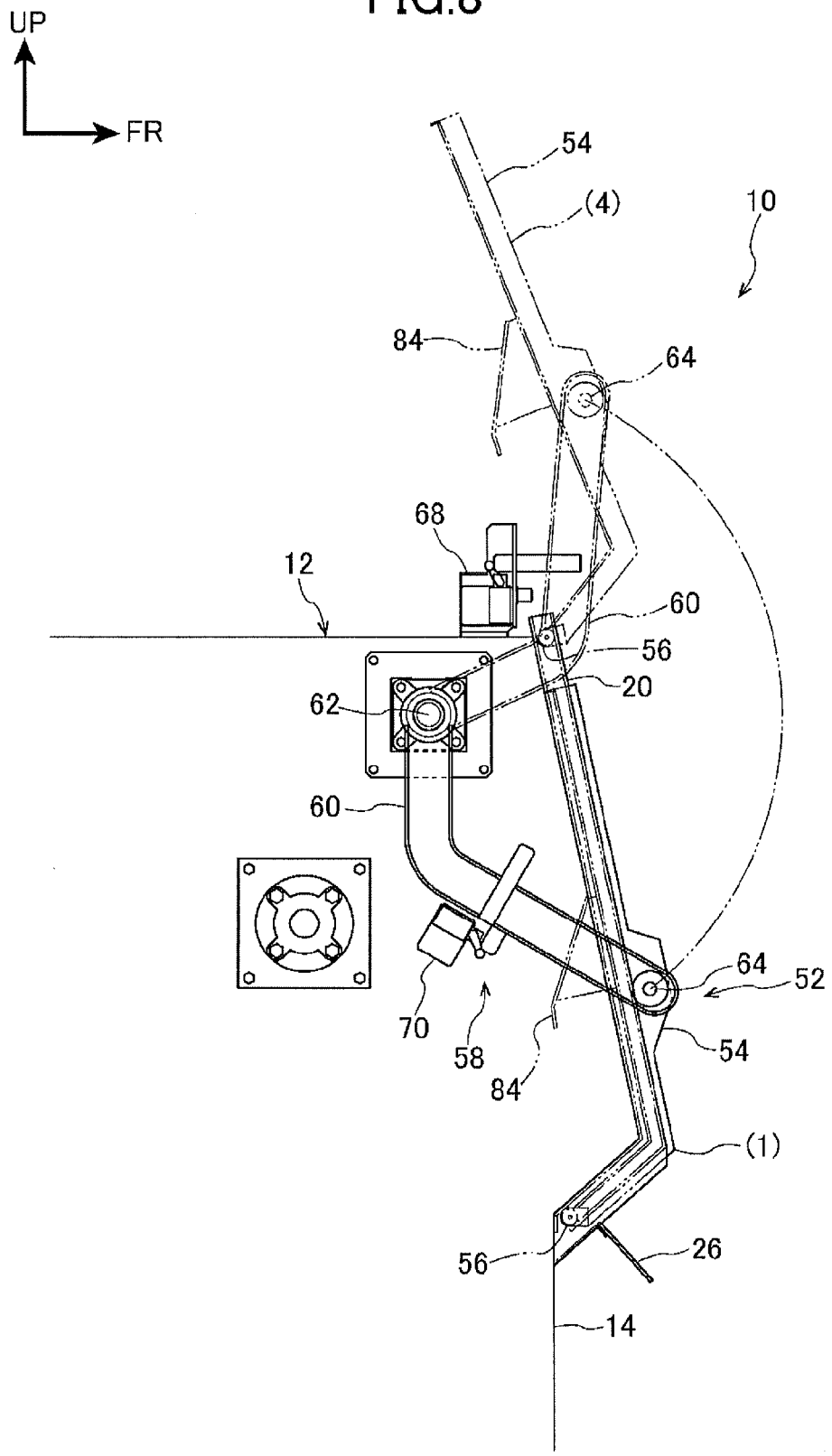
FIG. 8 is a left side elevation view of the FIG. 7 door unit.
Figure 9:
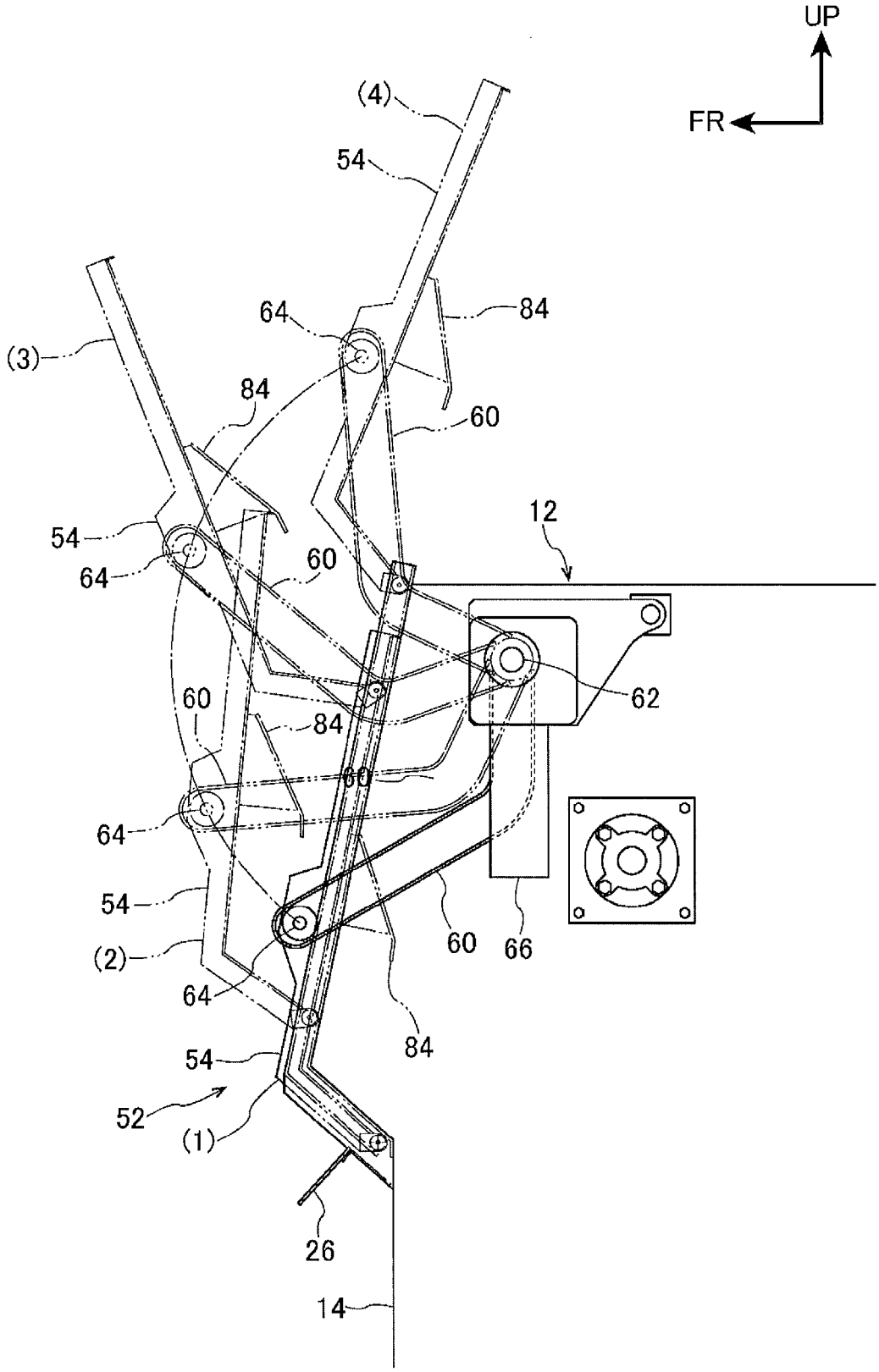
FIG. 9 is a right side elevation view of the FIG. 7 door unit.

As shown in FIGS. 8 and 9, a receiving plate 26 is disposed on the front wall 14 of the cabinet 12. The receiving plate 26 has an approximately V shape in cross section, and is disposed to extend in the width direction of the opening 18 so as to constitute the bottom end portion of the opening 18. The base end part of the receiving plate 26 projects forward from the front wall 14, and accepts and contacts the bottom end part of the door 54 when the door 54, provided on the opening 18, is disposed in the closed position shown by the solid line in FIG. 8.

Figure 6:
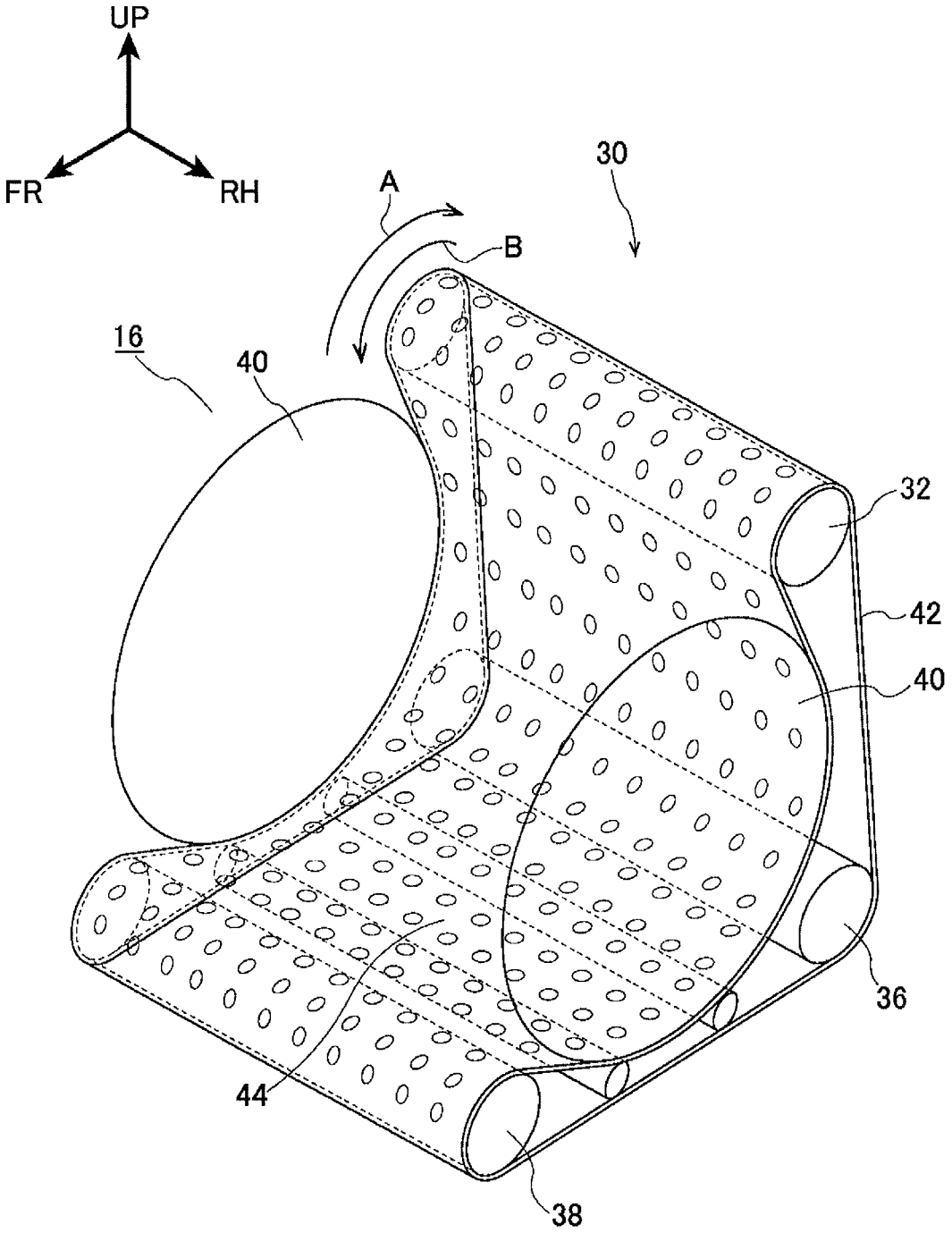
FIG. 6 is a perspective view of an apron used on the FIG. 2 shot blasting machine.

Moreover, as shown in FIG. 6, an apron 30 (agitating unit) is disposed inside the projection chamber 16 in the cabinet 12. This apron 30 comprises a drive roller 32, slave rollers 36, 38, a pair of head liners 40, and an apron belt 42 (agitating belt).

Drive roller 32 has an approximately cylindrical shape, and is rotatably supported on its axis by both side walls of the cabinet 12 so that the axis extends over the width direction of the cabinet 12. One end portion of this drive roller 32 is linked to an apron drive motor 34 (see FIG. 2) disposed on the cabinet 12, and the drive roller 32 is rotated by driving the apron drive motor 34.

The slave roller 36 is disposed below the drive roller 32, and the slave roller 38 is disposed on the opening 18 side, in a position at approximately the same height as the slave roller 36. Also, these slave rollers 36, 38 are approximately cylindrical, and are rotatably supported on their axes by the two side walls of the cabinet 12 so that their axes extend parallel to the axis of the drive roller 32. The distance between the axis of the drive roller 32 and the axis of the slave rod 36 is set to be approximately the same as the distance between the axis of the slave roller 36 and the axis of the slave rod 38.

The head liners 40 have an approximately cylindrical shape in which the length of the outside diameter is approximately equal to the distance between the drive roller 32 and the slave roller 36, and are respectively rotatably supported by the side walls of the cabinet 12. Also, the head liners 40 are disposed between the drive roller 32 and the slave roller 38.

The apron belt 42 is an endless belt. This apron belt 42 is wound around the drive roller 32 and around the pair of the slave rollers 36, 38, and by being contacted at both side edges by the outer circumferential portion of the head liners 40 is made to move through an approximately L-shaped endless track as shown in FIG. 6.

By this constitution, the apron belt 42 moves along the approximately L-shaped endless track, which is open toward the opening 18. The edge portions at both sides of the apron belt 42 are convexly curved downward in an arc shape along the outer perimeter of the head liners 40, and the horizontal portion curving convexly downward in this apron belt 42 becomes the agitating portion (apron) 44. Because the slave roller 38 is disposed adjacent to the inside surface of the door 54, the tip of the agitating portion 44 is also adjacent to the inside surface of the door 54.

During the shot processing, a workpiece is placed on the agitating portion 44, the apron belt 42 is rotated clockwise (the direction of arrow A in FIG. 6) by the driving of the apron drive motor 34, and workpieces are agitated on the agitating portion 44. At the same time, the rotation in the counterclockwise direction of the apron belt 42 by the driving of apron drive motor 34 results in the workpiece being transported toward the opening 18.

Figure 2:
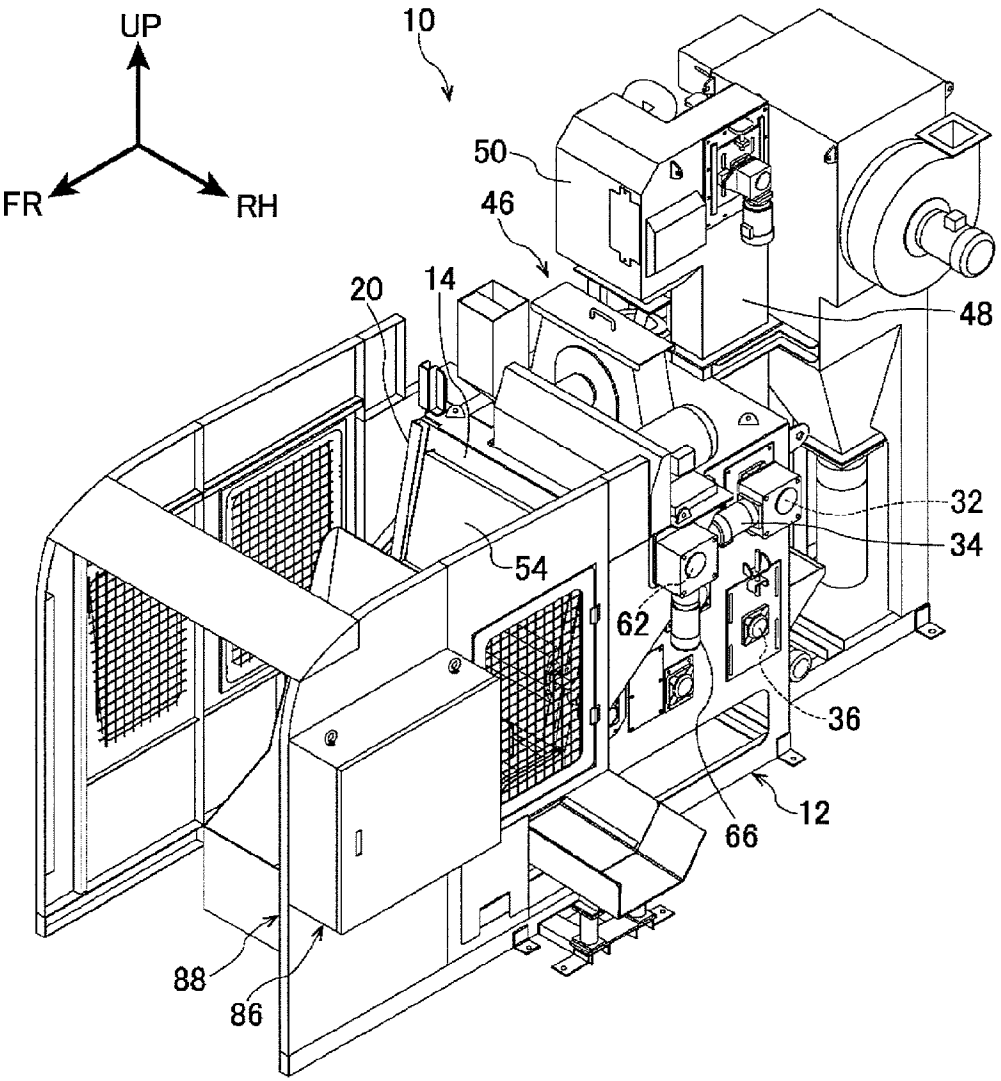
FIG. 2 is a perspective view showing the shot blasting machine of the first embodiment.
Figure 3:
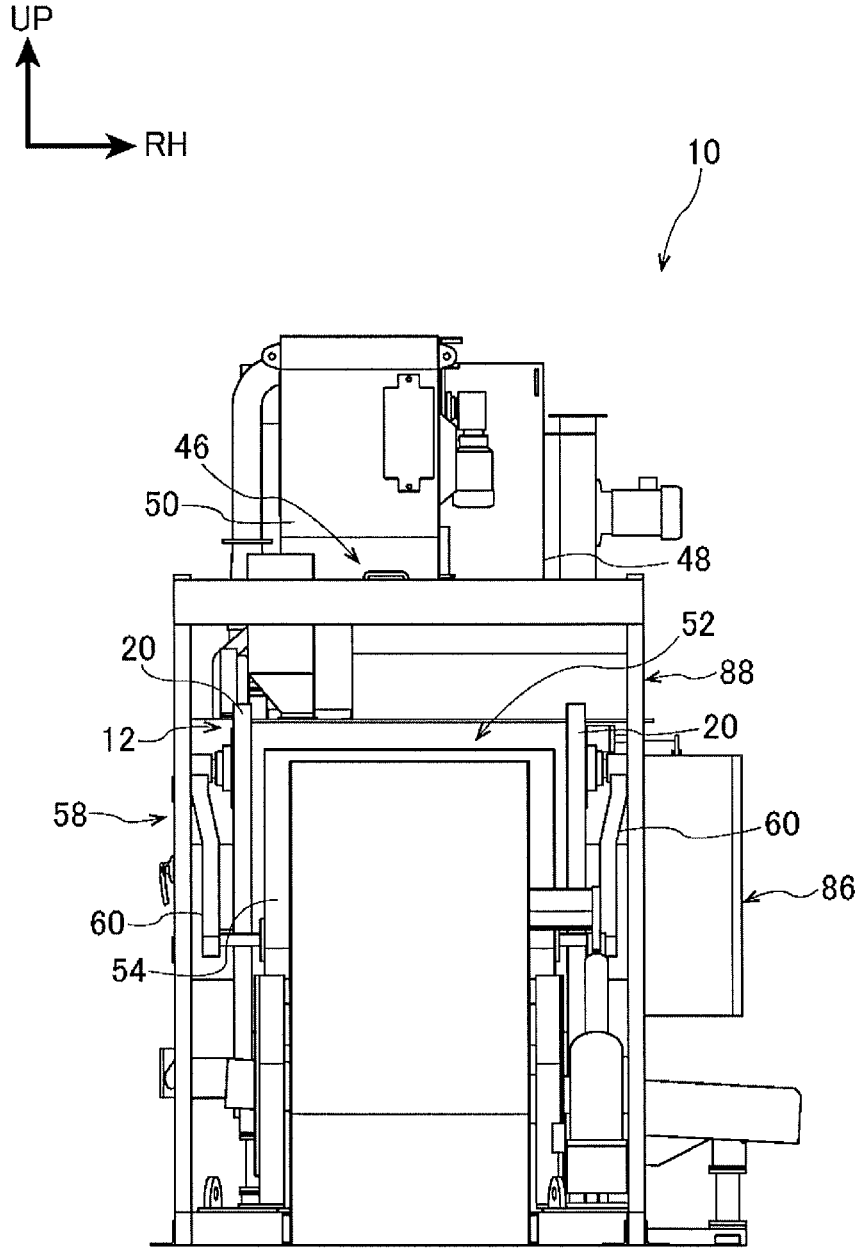
FIG. 3 is a front elevation view of the FIG. 2 shot blasting machine.
Figure 4:
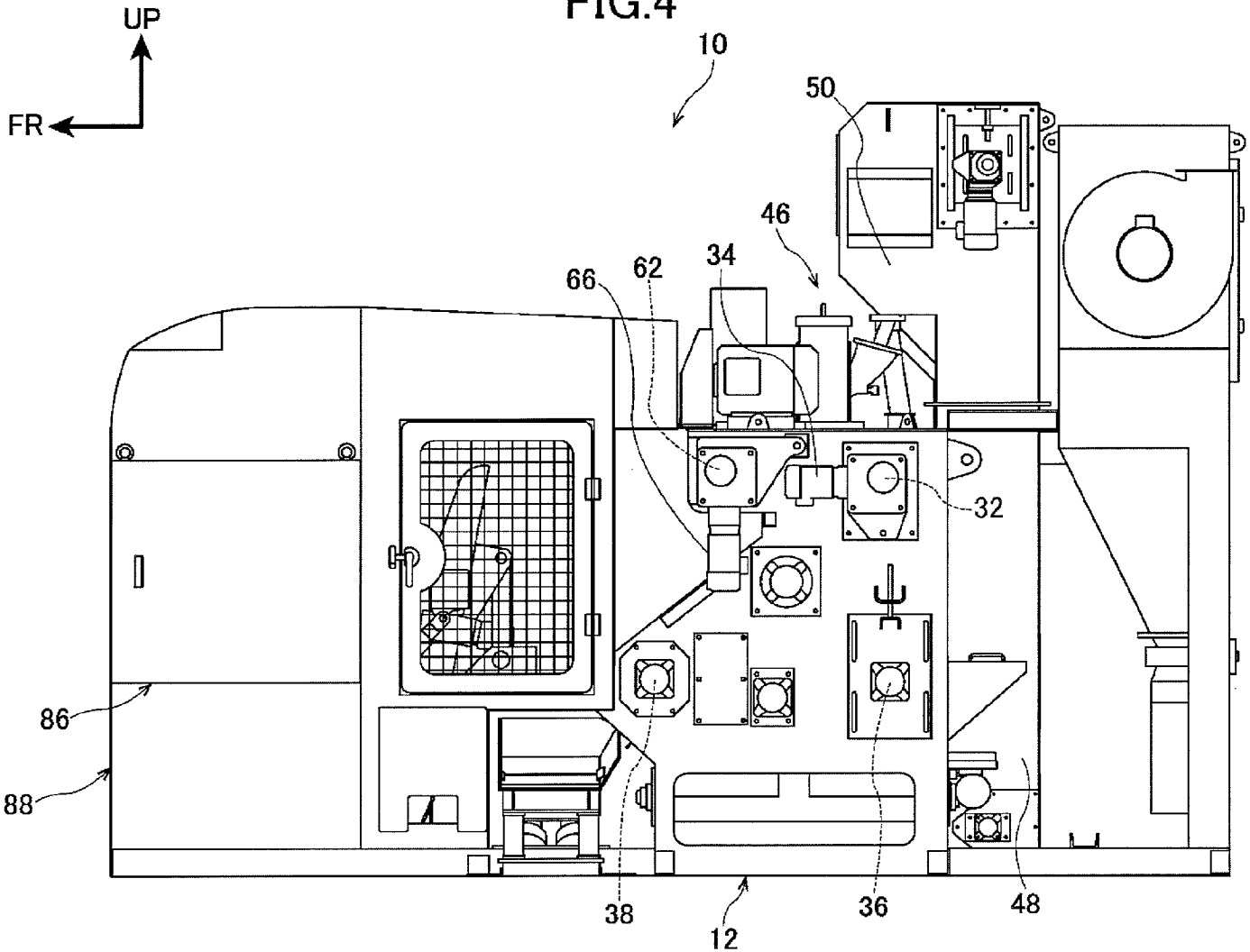
FIG. 4 is a right side elevation view of the FIG. 2 shot blasting machine.
Figure 5:
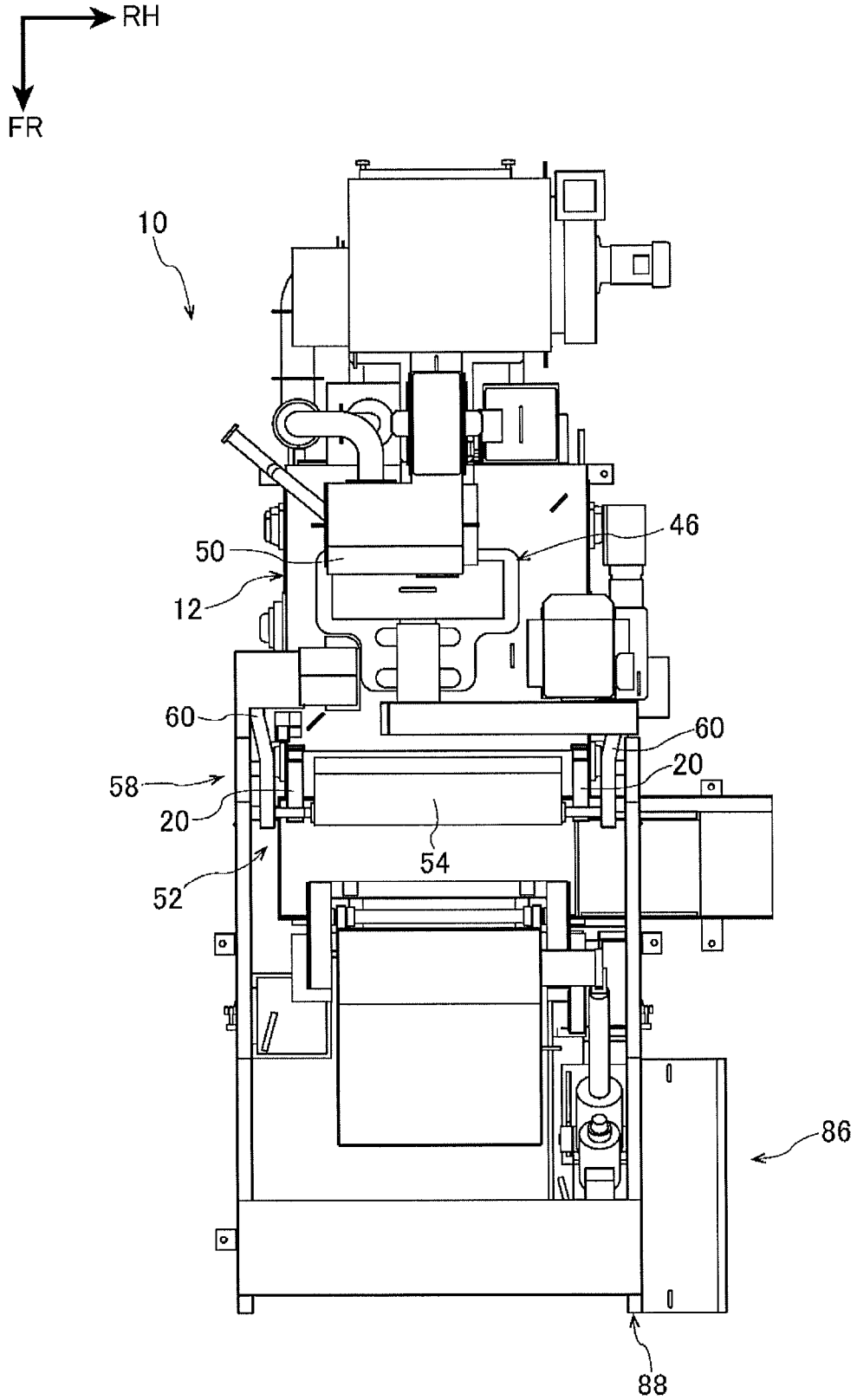
FIG. 5 is a plan view of the FIG. 2 shot blasting machine.

As shown in FIGS. 2 and 4, the projection unit 46 is placed on the top portion of the cabinet 12. The projection unit 46 is a centrifugal projection unit; projection material (shot) such as steel balls or the like is projected toward a workpiece in a projection chamber by the rotation of an impeller (not shown), thereby performing surface treatment on the workpiece.

Note that the projection material projected into the projection chamber 16 by the projection unit 46 drops down within the projection chamber 16. This projection material is recovered by a bucket elevator 48, then supplied to a separator 50 provided at the top of the cabinet 12, and a separation from impurities is performed by the separator 50. Separated projection material is again supplied to the projection unit 46.

Next the door unit 52 and the control section 86 forming a part of the above-described the cabinet 12, will be explained. As shown in FIGS. 7 through 9, the door unit 52 comprises a door 54 and a linking mechanism 58.

The door 54 is disposed, at a position shown by the solid line in FIGS. 8 and 9 (the closed position), to the front on the front wall 14 of the cabinet 12, so as to be capable of closing off the opening 18 on the cabinet 12. This the door 54 is an approximately rectangular panel body, disposed at an inclination so that its bottom portion is positioned on the outside of the cabinet 12. The bottom end portion of the door 54 is inclined so that the bottom side is positioned on the inside of the cabinet 12, and this bottom end portion, as described above, is housed in the closed position on the top side of the receiving plate 26 in the cabinet 12. Note that the bent bottom end portion is positioned under the lower slave roller 38 when the door 54 is closed.

A cam follower 56 is installed at the bottom end of both side edges of the door 54. The cam followers 56 are rotatably attached to the door 54 by the shaft that extends in the width axis of the door 54. In addition, each cam follower 56 is disposed inside the guide rails 20 in the cabinet 12, and by this means the bottom end portion of the door 54 is able to move up and down along the guide rails 20.

The shot blasting machine 10 comprises a linking mechanism 58 for linking the door 54 to the cabinet 12. The linking mechanism 58 comprises a pair of arms 60, and arms 60 are approximately L shaped as seen from the side. The base ends of the arms 60 are linked to the cabinet 12 so as to be rotatable about a first shaft 62 extending across the width direction of the door 54 (see FIG. 7). At the same time, the end portions of the arms 60 are linked to the door 54 so as to be rotatable about a second shaft 64 (see FIG. 7) extending across the width direction of the door 54.

A door drive motor 66, which is equipped with a speed reducer, is linked to the base portions of the arms 60, and driving by the door drive motor 66 (see FIGS. 7 and 9) enables movement of the arms 60 around the base end portions. Thus, the arms 60 are turned by the driving of the door drive motor 66 with the door 54 disposed in a closed position, thereby causing the door 54 to move upward to the position at which the opening 18 is fully open (see FIG. 8(4) and FIG. 9(4)), through positions (2) and (3) shown in FIG. 9, with the second shaft 64 following the arcuate path described by the tip of the arms 60, and the bottom end cam followers 56 following guide rails 20.

In addition, as shown in FIG. 8, an open position sensor 68 and a closed position sensor 70 are installed in the cabinet 12, and when the door 54 is moved to the open position or the closed position, the arms 60 press against either open position sensor 68 or closed position sensor 70. By this means, the fact that the door 54 has moved to the open position or the closed position is detected by the open position sensor 68 and the closed position sensor 70.

At the same time, as shown in FIGS. 1 and 10, an inside liner 72 is attached to the inside surface of the door 54 (the surface on the cabinet 12 side). The inside liner 72 is formed by an approximately rectangular rubber sheet with relatively high hardness. Note that FIG. 10 depicts the state in which the door 54 is disposed at a half-open position, described below. When the door 54 is disposed at the closed position, the front edge of the seal liner 22 contacts the inside liner 72, and the packing 24 contacts the inside liner 72, so that a seal is made between the cabinet 12 and the door 54.

Also, as shown in FIG. 1, four first fixing plates 74 (fixing members) are provided on the inside of the door 54. The first fixing plates 74 are approximately elongated rectangles in shape, and are fabricated using sheet metal. The first fixing plates 74 are attached to the door 54 using fastening members such as bolts, mediated by the inside liner 72.

The first fixing plates 74 are approximately long-length rectangular bodies; by being respectively disposed, when seen in front elevation, along the up-down direction at the two edge portions in the width direction of the inside liner 72 and at an inside position thereof, they are arrayed at equal intervals in the width direction of the inside liner 72.

Using this constitution, the inside liner 72 is fixed to the door 54 by the first fixing plates 74, and the first fixing plates 74 project toward the projection chamber 16 side from the inside liner 72.

First angled surfaces 78 (projection material adhesion prevention mechanism 76) are formed at the top end portion of the first fixing plates 74. As shown in FIG. 1, these first angled surfaces 78 slope so that the right end thereof is lower. Note that the first angled surfaces 78 may also be constituted so that the left end thereof is lower.

In addition, four second fixing plates (fixing members) 80 are attached to the inside of the bottom end portion 54*a* of the door 54. Second fixing plates 80 are fabricated from sheet metal, and are fastened onto the door 54 using a bolt or other fastening member, mediated by the inside liner 72. In this way, inside liner 72 is also fixed to the door 54 by the second fixing plates 80, and the second fixing plates 80 project from the inside liner 72 toward the projection chamber 16 side. Also, the second fixing plates 80 are formed in an approximately elongated rectangular shape and disposed to extend up and down, while being respectively disposed below each of the first fixing plates 74.

The second angled surfaces 82 (projection material adhesion prevention mechanism 76) are formed at the top end portion of the second fixing plates 80. As shown in FIG. 1, the second angled surfaces 82 slope so that the right end thereof is lower. Note that second angled surfaces 82 may also be constituted so that the left end thereof is lower.

Figure 11:
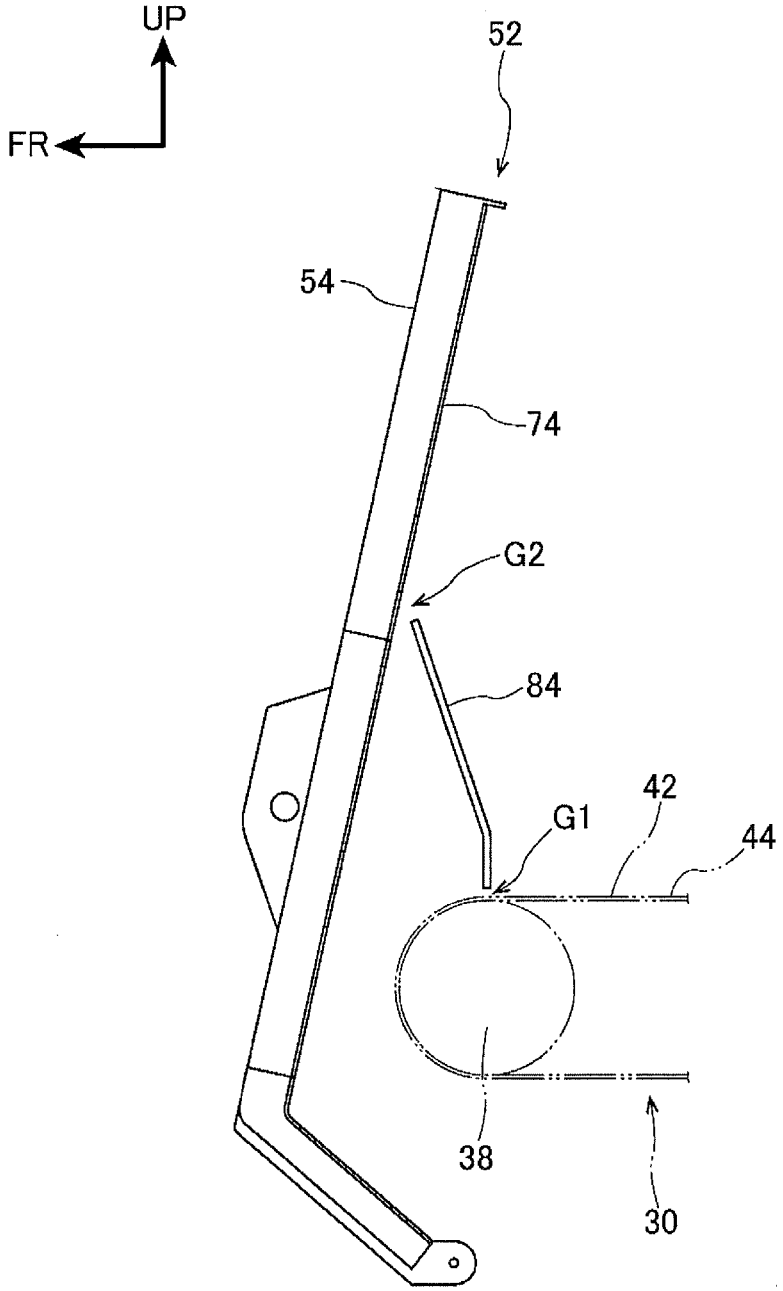
FIG. 11 is a diagram viewed from the direction of arrow 11 in FIG. 7.

A liner 84 constituting a return portion is attached on the inside of the door 54. The return liner 84 is an approximately rectangular plate body, and as shown in FIG. 1, is fixed to the door 54 through a bracket or the like, not shown, in an orientation in which the lower side separates from the door 54. Also, as shown in FIG. 11, the return liner 84 is angled so as to increasingly separate from the door 54 toward the bottom, and the bottom end portion thereof is bent downward so as to be disposed on the top side of the agitating portion 44 of the apron belt 42. Thus when a workpiece disposed on the agitating portion 44 is agitated by the apron 30, collision of the work into the door 54 is limited by the return liner 84. A gap G1 is formed between the bottom edge of the return liner 84 and the apron belt 42, and a gap G2 is formed between the top edge of the return liner 84 and the door 54 (inside liner 72).

As shown in FIG. 2, the control section 86 is attached to a frame unit 88 disposed at the front of the cabinet 12. The apron drive motor 34, the door drive motor 66, the open position sensor 68, the closed position sensor 70, and the like are electrically connected to the control section 86. The control section 86 comprises a control device equipped with a microprocessor or the like, and controls the entirety of the shot blasting machine 10. An operating section, not shown, is electrically connected to the control section 86, and rotation of the apron belt 42 and operations of the shot blasting machine 10 such as opening and closing the door 54 are controlled by operating the operating section.

The door 54 operates as shown below under the control of control section 86. I.e., when the door 54 is moved from the closed position (FIG. 12(A)) to the open position (FIG. 12(E)), the door 54 is temporarily stopped at the position shown in FIG. 12(B) (the "half-open position"). At this half-open position, the bottom edge portion of the door 54 is disposed on the top side of the receiving plate 26, and when viewed from above, the bottom edge portion of the door 54 and the receiving plate 26 overlap in the up-down direction. After the door 54 has been temporarily stopped, the door 54 is moved from the half-open position to the open position (FIGS. 12(C) and (D), then the door 54 is moved to the open position.

Next the operation and effect of shot blasting machine 10 in the present embodiment will be explained.

In the shot blasting machine 10 constituted above, workpieces are loaded from the opening 18 in the cabinet 12 into the projection chamber 16 with the door 54 disposed in the open position, then are disposed on the agitating portion 44 of the apron 30. By operation of the operating section, the door 54 is moved from the open position to the closed position, and the opening 18 is closed.

In this state, the apron drive motor 34 is driven under the control of the control section 86, and the apron belt 42 is rotated clockwise. Workpieces disposed on the agitating portion 44 of the apron 30 are thus agitated. Surface treatment of workpieces is performed by the projection of projection material by the projection unit 46 toward the workpieces.

When projection material is projected toward a workpiece, projection material scatters inside projection chamber 16. Since the door 54 is disposed at an angle so that its bottom edge is positioned to the front side, projection material hitting the inside liner 72, etc. of the door 54 drops downward in the projection chamber 16. Since the top edges of the first fixing plates 74 and the second fixing plates 80 are given the first angled surfaces 78 and second angled surfaces 82, projection material reaching the top end of the first fixing plates 74 and the second fixing plates 80 on the door 54 is guided by these angled surfaces and drops.

After surface treatment of workpieces is completed, the apron drive motor 34 is stopped. Next, by operating the operating section, the door 54 is moved from the closed position to a half-open position, and is temporarily stopped in a half-open position (FIG. 12(B)). Because the door 54 is temporarily stopped at a half-open position, projection material adhering or otherwise on the inside of the door 54 drops downward to the receiving plate 26 or within the projection chamber 16. Next, the door 54 moves from a half-open position to the open position (FIG. 12(E)).

With the door 54 disposed in the open position, the apron drive motor 34 is driven and the apron belt 42 is rotated counterclockwise under the control of the control section 86, and the workpieces are moved to the opening 18 side and discharged from the opening 18.

Here, the inside liner 72 is attached to the door 54, and the inside liner 72 is fixed to the door 54 by the first fixing plates 74 and the second fixing plates 80. The first angled surfaces 78 are formed at the top end portion of the first fixing plates 74, and the second angled surfaces 82 are formed at the top end portion of the second fixing plates 80. When projection material scattered inside projection chamber 16 reaches the first angled surfaces 78 and the second angled surfaces 82, the projection material is guided downward along the first angled surfaces 78 and the second angled surfaces 82 and is dropped. This restrains the accumulation of projection material on the top end of the first fixing plates 74 and the second fixing plates 80 projecting toward the projection chamber 16 from inside liner 72. Therefore, when the door 54 opens and opening 18 on the cabinet 12 opens, projection material adhering to or piled up on the top end of the first fixing plates 74 and the second fixing plates 80 is constrained from falling outside of the projection chamber 16.

Moreover, the first fixing plates 74 and the second fixing plates 80 are at least disposed along the up-down direction of both edge portions in the width direction of the inside liner 72. Since both edge portions in the width direction of the inside liner 72 are thus fixed to the door 54 by the first fixing plates 74 and the second fixing plates 80, curling up of the inside liner 72 is constrained, and accumulation of projection material on the first fixing plates 74 and the second fixing plates 80 can be constrained.

A gap G1 is formed between the return liner 84 and the apron belt 42. Thus accumulation of projection material between the return liner 84 and the apron belt 42 is constrained, and spilling over of projection material from the projection chamber 16 can be still further constrained.

I.e., when the return liner 84 is contacting the apron belt 42, projection material is prone to accumulate on this contacting part. When the door 54 is moved from the closed position to the open position, the projection material accumulated on this contacting part may spill over and fall outside the projection chamber 16. In this regard, a gap G1 is formed between the return liner 84 and the apron belt 42, therefore accumulation of projection material between the return liner 84 and the apron belt 42 is constrained, and spilling over and dropping of projection material from the projection chamber 16 can be still further constrained.

Furthermore, because a gap G2 is formed between the return liner 84 and the door 54, accumulation of projection material between the return liner 84 and the door 54 can be constrained. Thus the spilling over and dropping of projection material from the projection chamber 16 when the door 54 opens can be still further constrained.

When the door 54 is disposed at the closed position, the seal liner 22 contacts the inside liner 72, and the space between the cabinet 12 and the door 54 is sealed.

In shot blasting machine 10, when projection material is projected onto a workpiece, the projection material which scatters inside the projection chamber 16 contacts the seal liner 22 and the inside liner 72, therefore the seal liner 22 and the inside liner 72 must be constituted of a relatively high hardness material. For this reason, it is possible that the sealing characteristics between the cabinet 12 and the door 54 will degrade compared to the case in which the seal liner 22 is constituted by a relatively low hardness material.

Here a packing 24 is installed on the outside of the seal liner 22; the space between the door 54 and the cabinet 12 is also sealed by this packing 24. Thus even if projection material leaks from between the seal liner 22 and the inside liner 72, leakage of projection material outside of the projection chamber 16 can be constrained by the packing 24.

In addition, after the door 54 moves from the closed position toward the open position, the door 54 is temporarily stopped at a half-open position, then is moved toward the open position. By this means, projection material remaining on the door 54 can be made to drop down inside the projection chamber 16 with the door 54 in a temporarily stopped state. Therefore spilling over and dropping of projection material from the projection chamber 16 can be constrained by utilizing the door 54 opening and closing operation.

Also, in this half-open position the bottom edge portion of the door 54 is disposed on the top side of the receiving plate 26, and when viewed from above, the bottom edge portion of the door 54 and the receiving plate 26 overlap in the up-down direction. I.e., in a half-open position, receiving plate 26 is disposed directly under the door 54. For this reason, in a half-open position projection material which has reached the door 54 through the receiving plate 26 can be made to drop down inside the projection chamber 16. Thus when the door 54 is opened, projection material which has reached the door 54 can be effectively constrained from being carried away from the projection chamber 16.

Second Embodiment

Except for the way in which control is exercised by the control section 86 when the door 54 is moved from the closed position to the open position, a shot blasting machine 100 of the second embodiment is constituted in the same way as the shot blasting machine 10 of the first embodiment, as shown below.

Figures 13A, 13B, 13C, 13D:
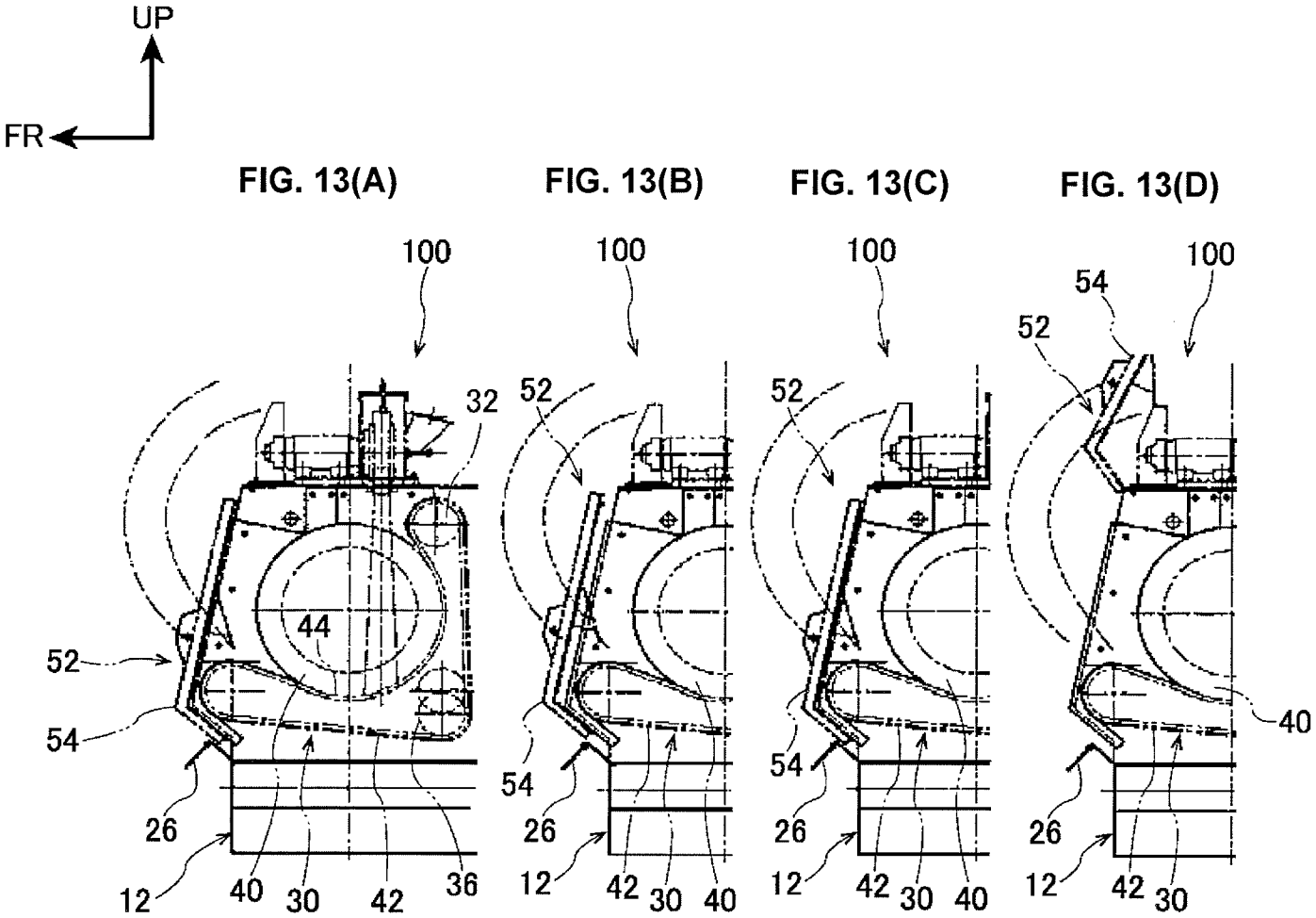
FIG. 13(A) is a side elevation view with the door on a shot blasting machine according to a second embodiment of the invention disposed in the closed position.
FIG. 13(B) is a side elevation view in which the door has been moved from the FIG. 13(A) state to a half-open position.
FIG. 13(C) is a side elevation view with the door moved to the closed position from the FIG. 13(B) state.
FIG. 13(D) is a side elevation view in which the door is moved to the open position from the FIG. 13(C) state.

I.e., in the shot blasting machine 100 of the second embodiment, the apron belt 42 is rotated clockwise at the closed position (FIG. 13(A)) by the control section 86 before the door 54 is moved from the closed position to the open position. After the apron belt 42 is rotated clockwise, the door 54 is moved from the closed position toward a half-open position, and is temporarily stopped at a half-open position (FIG. 13(B)). Furthermore, after temporarily stopping at a half-open position, the door 54 is again moved to the closed position (FIG. 13(C)), and is further moved to an open position (FIG. 13(D)).

Therefore the shot blasting machine 100 of the second embodiment can also render the same action and effect as the shot blasting machine 10 of the first embodiment.

Furthermore, with the shot blasting machine 100 of the second embodiment, as described above, the apron belt 42 is rotated clockwise before the door 54 moves from the open position to the closed position, so that workpieces are agitated by the apron 30 without projection material being projected in the projection chamber 16. Thus the door 54 can be moved to a half-open position after projection material has been fully removed from workpieces.

In the shot blasting machine 100 of the second embodiment, as described above, the door 54 is again returned from a half-open position to the closed position, therefore projection material remaining on the door 54 in the closed position can be caused to drop down to the projection chamber 16.

This invention is not limited to the above-described embodiments, and various changes or transformations are possible within the scope of the technical philosophy set forth in the Claims.

In the shot blasting machines of each of the embodiments above, multiple first fixing plates 74 and second fixing plates 80 are disposed to align with the up-down direction of the door. However the first fixing plates and second fixing plates may also be disposed to incline toward the center of the door 54 in the width direction relative to the up-down direction when seen in front elevation. I.e., it is possible, for example, to dispose multiple first fixing plates and second fixing plates symmetrically left and right relative to the width direction of the door, inclining them so they are disposed in approximately a V shape when seen in front elevation. In this case, the side surfaces (top end surface) of the first fixing plate and second fixing plate function as the "angled surfaces" of the invention, and projection material can be dropped to the projection chamber side by the side surfaces of the first fixing plates and second fixing plates.

In each of the embodiments above, first angled surfaces 78 and second angled surfaces 82 are disposed to incline in the left-right (width) direction. However, it is also acceptable to position first angled surfaces and second angled surfaces at an angle in the front-rear direction of the machine (i.e., the direction from the door facing inward on the machine) so that the edge on the door 54 side is positioned above, and the edge on the projection chamber 16 side is positioned below.

Furthermore, in each of the embodiments above, the door 54 is temporarily stopped at a half-open position under control of the control section 86, but a constitution is also acceptable in which the door 54 is moved to the open position without being temporarily stopped at a half-open position.

Furthermore, in each of the above embodiments, in order to hold workpieces on the projection chamber side during shot processing, a return liner 84 is installed, comprised of a rectangular plate body oriented at an angle so that the bottom edge side thereof separates from the door.

Figure 14:
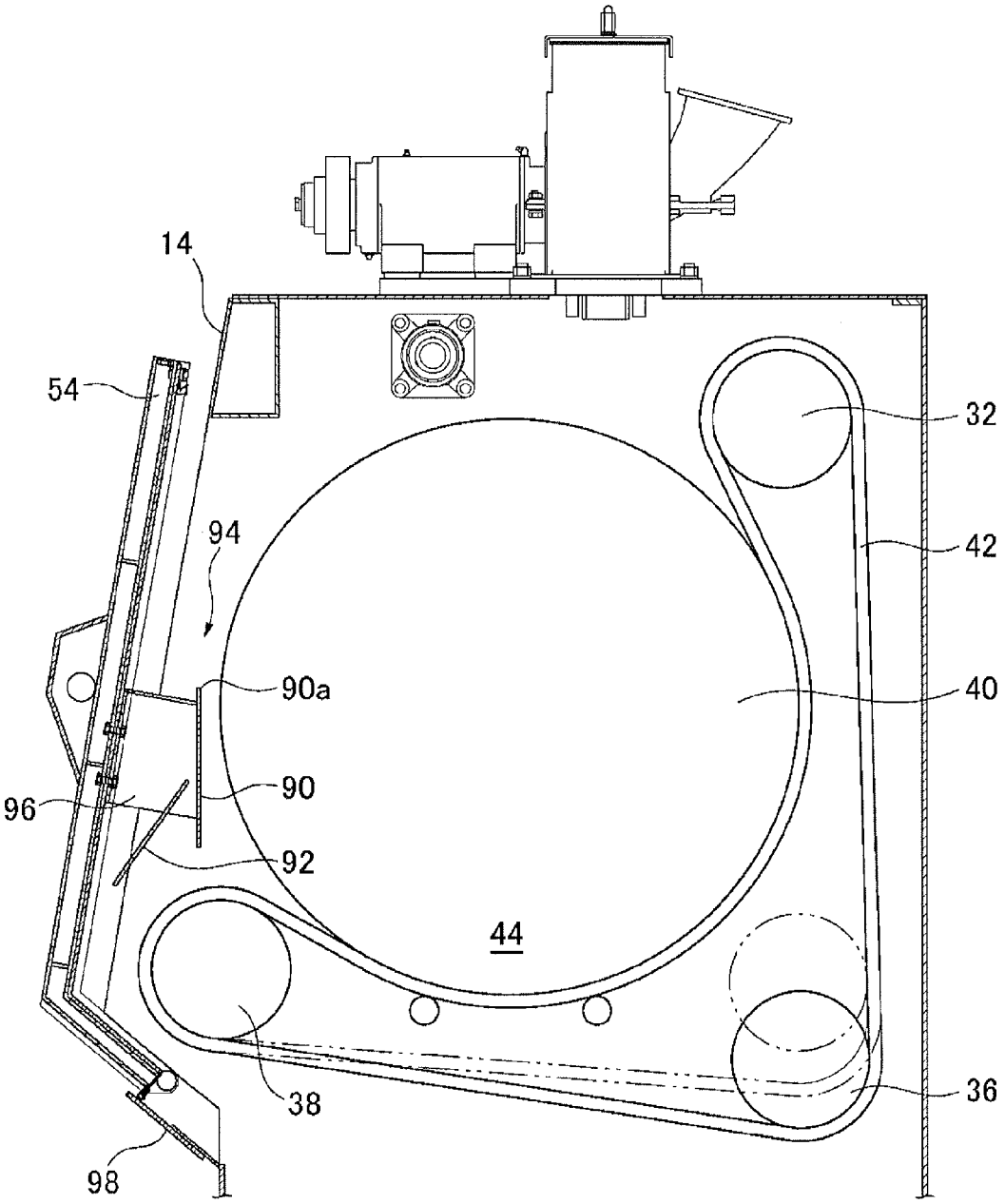
FIG. 14 is an overview cross section showing the constitution of a shot blasting machine according to another embodiment of the invention.
Figure 15:
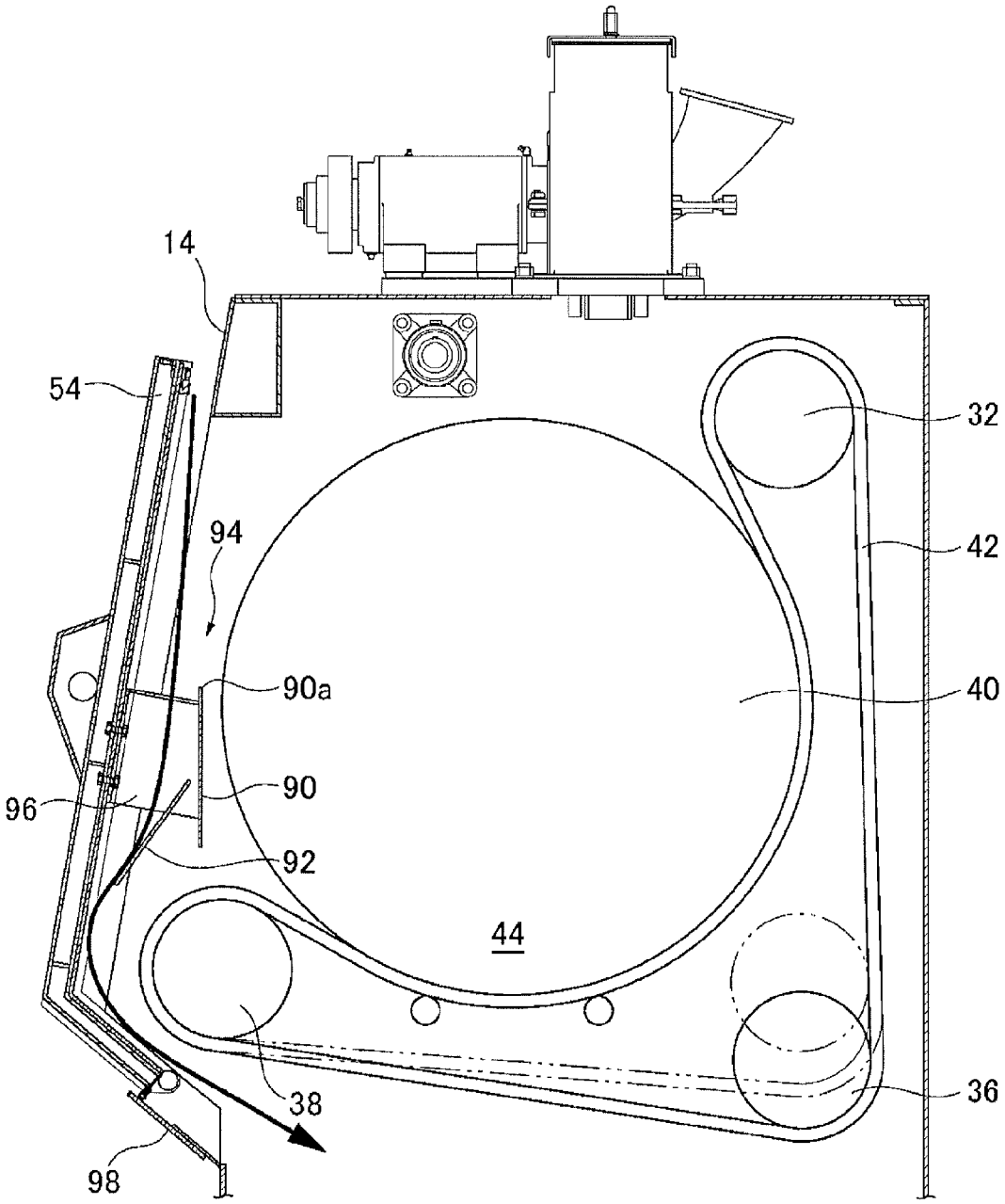
FIG. 15 is a diagram showing the flow of projection material in the FIG. 14 constitution.

However, as shown in FIG. 14, it is also acceptable, in lieu of the return liner 84, to provide a return portion 94 comprising a rectangular return plate 90 oriented at an angle so that the bottom end thereof separates from the door 54, and a flow straightening plate 92, installed on the door side of the return plate 90 and oriented at an angle so that the bottom end thereof approaches the door. The return plate 90 and flow straightening plate 92 are attached to the rear side of the door 54 by a bracket 96, for example. More specifically, the return plate 90 is attached to the rear side of the door 54 by the bracket 96 so that the top end portion 90*a* separates by a predetermined distance from the door 54.

In such a constitution, it is preferably to install a plate-shaped receiving plate 98 as shown in FIG. 14, in lieu of the receiving plate 26, which is V-shaped in cross section. In this plate-shaped receiving plate 98, the leading edge part projects significantly more outward than the leading edge part of V-shaped cross section receiving plate 26, and the gap is eliminated with respect to the door 54.

In a shot processing machine, projection material sandwiched during the projection operation between the door and the cabinet front wall 14 drops when the door is opened.

In the above-constituted return portion 94, the top end portion 90*a* of the return plate 90 is separated from the door 54 by a predetermined distance, therefore when projection material which had been sandwiched between the top portion of the door 54 and the cabinet front wall 14 during the projection operation drops when the door 54 is opened, it enters from between the top end portion 90*a* of the return plate 90 and the door 54 into the space between return plate 90 and the door 54, is deflected to the rear side of the door 54 by the flow straightening plate 92, and is additionally guided to the bottom of the agitating portion (apron) 44 by the rear surface of the bent bottom portion on the cabinet side of the door 54, and by the plate-shaped receiving plate 98.

As a result, projection material which had been sandwiched between the door 54 and the cabinet front wall 14 during shot processing does not drop into the agitating portion (apron) 44 where workpieces are housed, thereby preventing projection material sandwiched between the door 54 and the cabinet front wall 14 from dropping into the agitating portion (apron) 44, adhering to workpieces inside the agitating portion (apron) 44, and being discharged to outside the shot processing machine. Using such a constitution, the return plate 90 enables the prevention of workpiece collision with the door 54 during shot processing, and further constrains the discharge of projection material when the door is open.

What is claimed is:

1. A shot processing machine for performing surface treatment by projecting projection material onto a workpiece inside a projection chamber, comprising:

a cabinet within which the projection chamber is formed;

an opening disposed on the cabinet, for loading and discharging workpieces; and a door movably attached to the cabinet, for opening and closing the opening, wherein a projection material adhesion prevention mechanism for preventing the adhesion of projection material is provided on the inside of the door, and wherein an inside liner and a fixing member for fixing said inside liner to the door are provided on the inside surface of the door, and the projection material adhesion prevention mechanism is constituted by an angled surface formed on the top end surface of the fixing member.

2. The shot processing machine of claim 1, wherein the fixing member is an elongated plate-shaped member disposed on the inside surface of the door so as to extend in the vertical direction, and the angled surface is oriented so that the edge on one side thereof in the width direction of the fixing member is low.

3. The shot processing machine of claim 2, wherein the angled surface is oriented so that the center side in the width direction of the door is low.

4. The shot processing machine of claim 1, comprising an agitating mechanism, disposed at the bottom portion of the projection chamber, for agitating workpieces housed in the projection chamber by disposing them on an agitating belt to move them back and forth, wherein the agitating belt is oriented to move along an L-shaped path, and the tip of the horizontal portion of said L-shaped path is disposed adjacent to the inside surface of the door, a return portion is provided on the inside surface of the door to suppress collisions with the door side by workpieces disposed on the agitating belt caused by the forward and backward movement of said agitating belt, and a gap is formed between said return portion and the agitating belt.

5. The shot processing machine of claim 4, wherein the agitating belt is an endless belt, and the track thereof is an endless track.

6. The shot processing machine of claim 5, wherein the return portion is attached to the door with a gap formed between the door and the return portion.

7. The shot processing machine of claim 1, wherein a first seal member for contacting the inside liner when the door closes off the opening is provided around the perimeter of the opening in the cabinet, and a second seal member for sealing between the cabinet and the door when the door is closing off the opening is provided on the outer side of the first seal member.

8. The shot processing machine of claim 1, comprising a control section for controlling the opening and closing of the door, wherein when the door is being moved from a closed position in which the opening is closed to an open position in which the opening is opened, the control section implements a control so that the door is moved from the closed position toward the open position, then is temporarily stopped, then moved to the open position.

9. The shot processing machine of claim 8, wherein the control section controls the rotation of the agitating belt, and when the door is moved from the closed to the open position, the control section implements a control so that the agitating belt is turned in the clockwise direction, then the door is moved from the closed position toward the open position, following which the door is temporarily stopped, then again moved to the closed position, after which the door is moved to the open position.

10. The shot processing machine of claim 7, comprising a receiving plate which forms the bottom portion of the opening and projects from the cabinet at a position below the door, wherein the door and the receiving plate overlap in the up-down direction at the position where the door is temporarily stopped when moving from the closed position.

11. The shot processing machine of claim 1, comprising a projection material guide mechanism held between the door and the opening, for guiding projection material dropping when the door is opened, toward the bottom of the projection chamber.

12. The shot processing machine of claim 4, comprising a projection material guide mechanism for guiding projection material, held between the door and the opening and dropping when the door is opened, toward the bottom of the projection chamber.

13. The shot processing machine of claim 12, wherein the agitating belt is an endless belt; and the track thereof is an endless track.

14. The shot processing machine of claim 13, wherein the return portion is attached to the door with a gap formed between the door and the return portion.

15. The shot processing machine of claim 11, wherein the projection material guide mechanism comprises a flow straightening plate provided on the return portion, and a receiving plate provided at the bottom end of the opening.

16. The shot processing machine of claim 8, comprising a receiving plate which forms the bottom portion of the opening and projects from the cabinet at a position below the door, wherein the door and the receiving plate overlap in the up-down direction at the position where the door is temporarily stopped when moving from the closed position.

* * * * *